US006440236B1

(12) United States Patent
Hiramatsu et al.

(10) Patent No.: US 6,440,236 B1
(45) Date of Patent: Aug. 27, 2002

(54) ULTRA-HIGH STRENGTH METASTABLE AUSTENITIC STAINLESS STEEL CONTAINING TI AND A METHOD OF PRODUCING THE SAME

(75) Inventors: Naoto Hiramatsu, Tokuyama; Kouki Tomimura, Houfu, both of (JP)

(73) Assignee: Nisshin Steel Co., Ltd., Tokyo (JP)

( * ) Notice: Subject to any disclaimer, the term of this patent is extended or adjusted under 35 U.S.C. 154(b) by 0 days.

(21) Appl. No.: 09/703,896

(22) Filed: Nov. 2, 2000

(30) Foreign Application Priority Data

Nov. 5, 1999 (JP) ..... 11-315248

(51) Int. Cl.[7] ..... C22C 38/44
(52) U.S. Cl. ..... 148/608; 148/325; 148/327
(58) Field of Search ..... 148/325, 327, 148/607, 608

(56) References Cited

U.S. PATENT DOCUMENTS 4,878,955 A * 11/1989 Hoshino et al. ..... 148/325
5,494,537 A * 2/1996 Miyakusu et al. ..... 148/325

FOREIGN PATENT DOCUMENTS

| | | |
|---|---|---|
| JP | 61-295356 | 12/1986 |
| JP | 4-202643 | 7/1992 |
| JP | 6-207250 | 7/1994 |
| JP | 7-300654 | 11/1995 |

* cited by examiner

*Primary Examiner*—Sikyin Ip
(74) *Attorney, Agent, or Firm*—McDermott, Will & Emery

(57) ABSTRACT

An ultra-high strength metastable austenitic stainless steel exhibiting a tensile strength of not less than 2200 N/mm$^2$ has a chemical composition comprising, in mass %, not more than 0.15 % of C, more than 1.0 to 6.0 % of Si, not more than 5.0 % of Mn, 4.0–10.0 % of Ni, 12.0–18.0 % of Cr, not more than 3.5 % of Cu, not more than 5.0 % of Mo, not more than 0.02 % of N, 0.1–0.5 % of Ti, optionally one or both of not more than 0.5 % of V and not more than 0.5 % of Nb, and the balance of Fe and unavoidable impurities, satisfies Si+Mo≧3.5 %, has a value of Md(N) defined by the equation Md(N)=580-520C-2Si-16Mn-16Cr-23Ni-300N-26Cu-10Mo of 20–140, exhibits a cold worked multiphase texture composed of 50–95 vol % of martensite phase and the remainder substantially of austenite phase, and has Mo-system precipitates and Ti-system precipitates distributed in the martensite phase.

9 Claims, 3 Drawing Sheets

ULTRA-HIGH STRENGTH METASTABLE AUSTENITIC STAINLESS STEEL CONTAINING TI AND A METHOD OF PRODUCING THE SAME

BACKGROUND OF THE INVENTION

1. Field of the Invention

This invention relates to a stainless steel that is an optimum material for members and components requiring corrosion resistance together with high strength and fatigue property, such as flat springs, coil springs, blade plates for Si single crystal wafer fabrication, particularly to an ultra-high strength metastable austenitic stainless steel having extremely high tensile strength, and a method of producing the same.

2. Background Art

When manufacturing members or components such as the foregoing from stainless steel, a martensitic stainless steel, work-hardened stainless steel or precipitation-hardened stainless steel has conventionally been used.

Martensitic stainless steels are produced by quenching from the high-temperature austenitic state to achieve hardening by martensite transformation. Examples include SUS410 and SUS420J2. High strength and toughness can be obtained by subjecting these steels to quench-anneal tempering treatment. When the product is extremely thin, however, it is deformed by the thermal strain during quenching. This makes it difficult to fabricate the product in the desired shape.

In the case of work-hardened stainless steels, a steel exhibiting austenite phase in the solution treatment state is thereafter cold-worked to generate strain-induced martensite phase for the purpose of obtaining high strength. Typical examples of these metastable austenitic stainless steels are SUS301 and SUS304. Their strength depends on the amount of cold-working and the amount of martensite. The problem of thermal strain during quenching mentioned above does not arise. Precise adjustment of strength solely by cold-working is, however, very difficult. When the cold-working rate is too high, anisotropy increases to degrade toughness.

Precipitation-hardened stainless steels are obtained by inclusion of an element with high precipitation hardness ability and age-hardening. SUS630, containing added Cu, and SUS631, containing added Al, are typical types. The former exhibits martensite single phase after solution treatment and is age-hardened from this state. The tensile strength achieved is only around 1400 N/mm$^2$ at the greatest. The latter exhibits metastable austenite phase after solution treatment and is age-hardened after this phase has been partially converted to martensite phase by cold-working or other such preprocessing. The hardening is achieved by precipitation of the intermetallic compound $Ni_3Al$ and the tensile strength can be raised to around 1800 N/mm$^2$ by positive generation of martensite phase.

Stainless steels utilizing such age-hardening also include ones developed to have higher strength than the foregoing conventional ones. Japanese Patent Application Laid-Open (KOKAI) No. 61-295356 (1986) and Laid-Open No. 4-202643 (1992), for instance, teach methods of subjecting metastable austenitic stainless steels added with Cu and Si in combination to an appropriate degree of cold-working followed by age-hardening. These methods provide high-strength steels of a tensile strength of around 2000 N/mm$_2$. However, the age-hardening temperature range for obtaining high hardness by these methods is very narrow. Application to commercial production is therefore not easy.

In Japanese Patent Application Laid-Open No. 6-207250 (1994) (hereinafter '250) and Laid-Open No. 7-300654 (1995) (hereinafter '654), the present inventors later disclosed that a high-strength steel of a tensile strength of about 2000 N/mm$^2$ and also excellent in toughness can be obtained by subjecting a metastable austenitic stainless steel added with Mo and Si in combination to an appropriate degree of cold-working and thereafter conducting age-hardening at a high temperature. Although this method requires strict control of the steel composition, this requirement can be fully met with today's steelmaking techniques. Moreover, since the age-hardening temperature range is broad and age-hardening can be effected in a short time, the method is suitable for continuous production of steel strip.

The teachings of the aforesaid '250 and '654 can be said to have substantially established a production technology for high-strength stainless steel of 2000-N/mm$^2$-class strength. Recently, however, an increasing need is being felt for stainless steel materials of still higher strength, mainly for use as spring material and in blade plates. To respond to this need, there should desirably be developed and supplied steel materials that can be reliably obtained with a tensile strength on not less than 2200 N/mm$^2$.

On the other hand, 18 Ni maraging steel is known as an ultra-high strength metal material having tensile strength on the order of 2000–2400 N/mm$^2$. For example, it is know that 18 Ni-9 Co-5 Mo-0.7 Ti-system maraging steel and 18 Ni-12.5 Co-4.2 Mo-1.6 Ti-system maraging steel achieve tensile strengths on the order of 2000 N/mm$^2$ and 2400 N/mm$^2$, respectively. These steels are also relatively good in toughness. They are, however, very high in cost because they contain large amounts of expensive elements like Ni, Co and Mo. Practical application of these steels as a material for inexpensive springs and the like is therefore impossible.

In view of the foregoing circumstances, the object of the present invention is to manufacture and provide an ultra-high strength metal material exhibiting a high tensile strength of not less than 2200 N/mm$^2$ using metastable austenitic stainless steel as a material. Moreover, this invention is capable of providing not only steel strip obtained by aged on a continuous line but also steels that are aged by batch processing after processing into various components.

SUMMARY OF THE INVENTION

The inventors made various attempts to increase the tensile strength of the steels taught by '250 and '654 to the order of 2200 N/mm However, they were unable consistently obtain such high strength in these steels. Through further studies they learned that production of the steels taught by '250 and '654 at a strength exceeding 2000 N/mm$^2$ involves a fundamental difficulty from the aspect of alloy design. They therefore concluded that development of a new steel having a different chemical composition was necessary. Pursuing this line of reasoning, they learned that, from the aspect of steel type, it is, as heretofore, advantageous to use a precipitation-hardened metastable austenitic stainless steel added with Mo and Cu and further that a high strength on the order of 2200 N/mm$^2$ can be obtained by, differently from the conventional practice, adopting a composition system additionally containing Ti. They also learned that it is very preferable to conduct cold-working to generate strain induced martensite phase in the metallic texture so as to obtain a texture of 50–95 vol % of martensite+austenite before aging. This invention was accomplished based on this knowledge.

In a first aspect of the invention, the foregoing object is achieved by providing an ultra-high strength metastable austenitic stainless steel having a chemical composition comprising, in mass %, not more than 0.15% of C, more than 1.0 to 6.0% of Si, not more than 5.0% of Mn, 4.0–10.0% of Ni, 12.0–18.0% of Cr, not more than 3.5% of Cu, not more than 5.0% of Mo, not more than 0.02% of N, 0.1–0.5% of Ti, and the balance of Fe and unavoidable impurities, satisfying Si+Mo≧3.5%, having a value of Md(N) defined by equation (1) below of 20–140, exhibiting a cold worked multiphase texture composed of 50–95 vol % of martensite phase and the remainder substantially of austenite phase, and having Mo-system precipitates and Ti-system precipitates distributed in the martensite phase:

$$Md(N)=580-520C-2Si-16Mn-16Cr-23Ni-300N-26Cu-10Mo \quad (1).$$

By "substantially of austenite phase" is meant that precipitates, intermetallic inclusions and small amount (roughly less than 1%) of δ ferrite phase can be included. The presence of a cold worked texture can be determined from, for example, the fact that the austenite crystal grains are found to extend in the working direction when observed with an optical microscope. Typical Mo-system precipitates include $Fe_2Mo$ and $Fe_3Mo$. Typical Ti-system precipitates include $Ni_{16}Ti_6Si_7$ (G phase) and $Ni_3Ti$. The presence of these precipitates can be determined by a microscopic observation method using an electron microscope, for example.

In a second aspect of the invention, an ultra-high strength metastable austenitic stainless steel according to the first aspect is provided wherein the steel further comprises at least one of not more than 0.5 mass % of V and not more than 0.5 mass % of Nb. In other words, the second aspect of the invention provides an ultra-high strength metastable austenitic stainless steel having a chemical composition comprising, in mass %, not more than 0.15% of C, more than 1.0 to 6.0% of Si, not more than 5.0% of Mn, 4.0–10.0% of Ni, 12.0–18.0% of Cr, not more than 3.5% of Cu, not more than 5.0% of Mo, not more than 0.02% of N, 0.1–0.5% of Ti, at least one of not more than 0.5% of V and not more than 0.5% of Nb, and the balance of Fe and unavoidable impurities, satisfying Si+Mo≧3.5%, having a value of Md(N) defined by equation (1) of 20–140, exhibiting a cold worked multiphase texture composed of 50–95 vol % of martensite phase and the remainder substantially of austenite phase, and having Mo-system precipitates and Ti-system precipitates distributed in the martensite phase.

In a third aspect of the invention, a steel according to the first or second aspect is provided wherein Cu content is 1.0–3.0 mass % and Mo content is 1.0–4.5 mass %.

In a fourth aspect of the invention, a steel according to any of the first to third aspects is provided wherein the steel is sheet steel or wire steel having a tensile strength of not less than 2200 $N/mm^2$.

In a fifth aspect of the invention, a method of producing an ultra-high strength metastable austenitic stainless steel having a tensile strength of not less than 2200 $N/mm^2$ is provided which comprises a step of solution-treating a steel having a chemical composition according to the first aspect of the invention, a step of cold-working the solution-treated steel to obtain a steel having a metallic texture composed of 50–95 vol % of martensite phase, and a step of aging the cold-worked steel in a temperature range of 300–600° C. for 0.5–300 minutes. The "50–95 vol % of martensite phase" referred to here consists primarily of strain-induced martensite phase newly generated by the cold-working but also includes any cooling-induced martensite phase already present after the solution treatment. Portions other than the martensite phase are substantially austenite phase.

In a sixth aspect of the invention, the method according to the fifth aspect is applied to a steel further comprising at least one of not more than 0.5 mass % of V and not more than 0.5 mass % of Nb, i.e., a steel having a chemical composition according to the second aspect.

In a seventh aspect of the invention, the method according to the fifth or sixth aspect is applied to a steel wherein Cu content is 1.0–3.0 mass % and Mo content is 1.0–4.5 mass %.

In an eighth aspect of the invention, the method according to any of the fifth to seventh aspects is provided wherein the steel subjected to aging is a steel having a metallic texture composed of 50–95 vol % of martensite phase obtained by conducting the solution-treating step to attain a texture consisting of austenite single phase or a texture consisting primarily of austenite phase and containing not more than 30 vol % of cooling-induced martensite phase and thereafter cold-working the steel to generate strain-induced martensite phase.

In a ninth aspect of the invention, the method according to any of the fifth to eighth aspects is provided wherein the aging step is conducted batchwise for 10–300 minutes.

DESCRIPTION OF THE PREFERRED EMBODIMENTS

Figure 1:
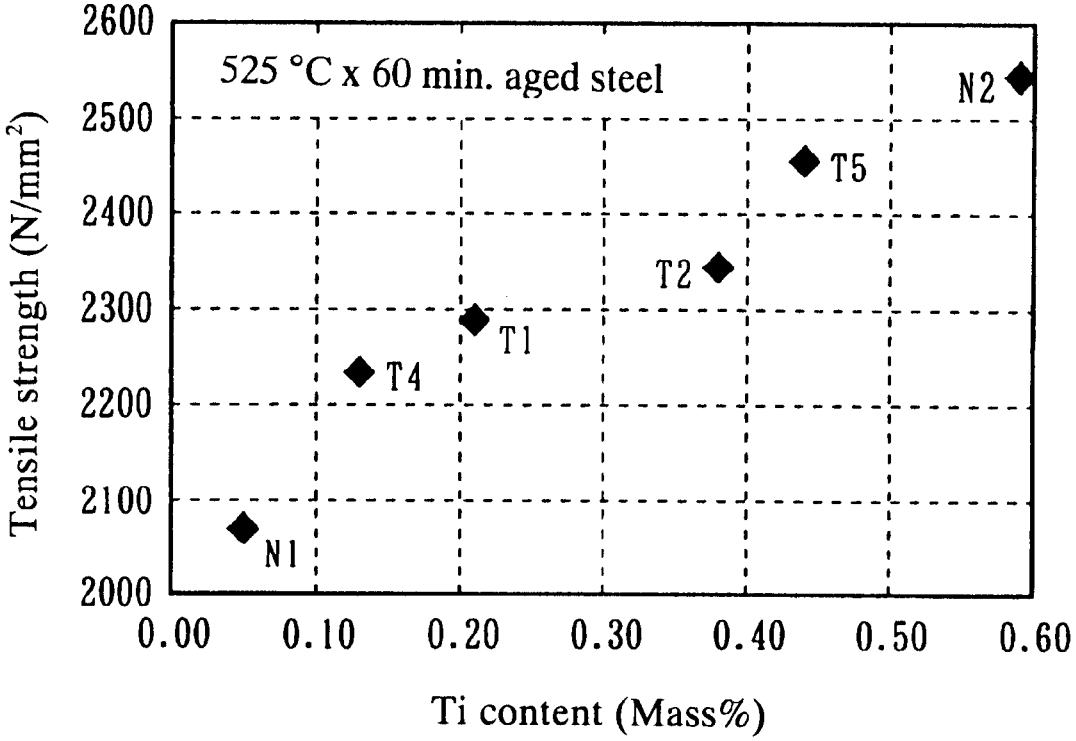
FIG. 1 is a graph showing the effect of Ti content on the tensile strength of steels aged at 525° C. for 60 minutes.

As a condition for enabling realization of an ultra-high strength metastable austenitic stainless steel having a tensile strength of not less than 2200 $N/mm^2$, this invention defines a unique steel chemical composition having strictly limited constituent ranges. In addition, the metallic texture of the steel is preferably optimized before aging.

Features defining the invention will now be explained.

C (carbon) is an austenite-forming element. It is very effective for suppressing of δ ferrite phase generated at high temperature and for enforcing the solid solution hardening of martensite phase induced by cold-working. When C content is too large, however, coarse Cr carbides readily occur during aging and these tend to degrade grain-boundary corrosion resistance. Moreover, a large amount of Ti carbides are also formed, owing to the Ti content of the invention steel, and these degrade the fatigue property of the steel. In order to prevent these harmful effects, C content is limited to not more than 0.15 mass % in this invention.

Si (silicon) is ordinarily used in work-hardened stainless steels and the like for the purpose of deoxidation, at a content of not more than 1.0 mass %, as seen in SUS301 and SUS304. In this invention, however, a larger content of Si than this is used to produce an effect of markedly promoting generation of strain-induced martensite phase during cold-working. Si also contributes to post-aging strength improvement by hardening the strain-induced martensite phase and also hardening the austenite phase by entering it in solid solution. Moreover, it increases aging hardenability by interaction with Cu during aging. A Si content of more than 1.0 mass % is necessary for gaining the full benefit of these Si effects. When the content exceeds 6.0 mass %, however, high-temperature cracking is easily induced during coil-to-coil welding even if the cooling temperature is controlled. This causes various manufacturing problems. Si content is therefore defined as more than 1.0 to 6.0 mass %. Si content is preferably more than 1.0 to 4.0 mass %.

Mn (manganese) is an element that governs austenite phase stability. Since martensite phase is hard to induce during cold-working when the Mn content is large, its content is defined as not more than 5.0 mass %. The actual content is defined within this range taking into account balance with other elements. The lower limit of Mn content is preferably 0.2 mass % and the upper limit thereof is preferably 2.5 mass %.

Ni (nickel) is an element required for obtaining austenite phase at high temperature and room temperature. In this invention, it is necessary to give particular attention to attaining a post-solution treatment texture consisting of austenite single phase or consisting primarily of austenite phase and containing not more than 30 vol % of cooling-induced martensite phase. When the Ni content is less than 4.0 mass %, such a texture is hard to obtain because a large amount of δ ferrite phase is generated at high temperature and, in addition, martensite phase is readily generated during cooling to room temperature from the solution treatment temperature. On the other hand, martensite phase is hard to induce by cold-working when Ni content exceeds 10.0 mass %. Ni content is therefore defined as 4.0–10.0 mass %. The lower limit of Ni content is preferably 5.0 mass % and the upper limit thereof is preferably 8.5 mass %.

Cr (chromium) is an element required for securing corrosion resistance. In view of the uses anticipated for the invention steel, a Cr content of not less than 12.0 mass % is required. As Cr is a ferrite-forming element, however, δ ferrite phase is readily generated at high temperature when the content thereof is large. Austenite-forming elements (C, N, Ni, Mn, Cu etc.) have to be added to cancel out this effect but addition of excessive amounts of these elements stabilizes the austenite phase and results in insufficient induction of martensite phase by cold-working. The upper limit of Cr content is therefore set at 18.0 mass %. Cr content is preferably 12.0–16.5 mass %.

Cu (copper) exhibits a marked hardening effect by interaction with Si during aging. However, presence of excessive Cu degrades hot-workability to become a cause of steel cracking. Cu content is therefore defined as not more than 3.5 mass %. The lower limit of Cu content is preferably 1.0 mass % and the upper limit thereof is preferably 3.0 mass %. Most preferably, Cu content is more than 1.0 to 3.0 mass %.

Mo (molybdenum) improves corrosion resistance and exhibits an effect of finely dispersing carbides and/or nitrides during aging. This invention utilizes a high aging temperature in order to reduce rolling strain from an excessive level that would adversely affect fatigue property. However, too rapid release of strain during high-temperature aging is disadvantageous from the viewpoint of strength. The element Mo is highly effective for suppressing abrupt strain release during high-temperature aging. Mo also forms precipitates ($Fe_2Mo$, $Fe_3Mo$ etc.) during aging. These Mo-system precipitates occur in a form effective for strength enhancement even when aging is conducted at considerably high temperature. Strength decrease by high-temperature aging can therefore be prevented by Mo addition. As δ ferrite phase is readily generated at high temperature when Mo content is too large, however, Mo content is defined as not more than 5.0 mass %. Mo content of not less than 1.0 mass % should preferably be secured to gain the full benefit of the foregoing effects of Mo. When hot-workability is a major concern, however, the upper limit of Mo content should preferably be set at 4.5 mass %, because deformation resistance at high temperature is high when Mo content is large. The lower limit of Mo content is therefore preferably 1.0 mass % and the upper limit thereof is preferably 4.5 mass %.

N (nitrogen) is an austenite-forming element and is also known as an effective element for hardening austenite phase and martensite phase. Positive addition of N has therefore generally been considered advantageous for achieving high strength in stainless steels. In this invention, however, it was found that, owing to the adoption of Ti addition to be explained hereinafter, addition of N makes it difficult to obtain excellent fatigue property. Specifically, when N content is high, a large amount of TiN intermetallic inclusions are formed that work to degrade fatigue property. Based on the results of various studies, in this invention, which calls for Ti addition, it was found preferable from the viewpoint of obtaining the fatigue property desired of an ultra-high strength steel, not to add N but rather to hold N content to a low level of not more than 0.02 mass %. Moreover, it was ascertained that an ultra-high strength steel with a tensile strength on the order of 2200 $N/mm^2$ can be obtained even when N content is lowered to not more than 0.02 mass %. N content is therefore defined as not more than 0.02 mass % in this invention.

Ti (titanium) is an important added element in this invention. Ti is known to contribute to strength enhancement of stainless steels by forming aging precipitants. Aside from maraging stainless steels added with large amounts of Co, however, there have not been reported any stainless steel (i.e., stainless steel composed of ordinary constituent elements) that utilizes Ti precipitation hardening to achieve an ultra-high strength of 2200 $N/mm^2$. This can be attributed to the formidable difficulties encountered in connection with Ti addition, most notably (1) that it is extremely difficult to obtain an ultra-high strength level as high as 2200 $N/mm^2$ by aging a martensite texture steel, either by utilizing Ti precipitation hardening alone or by additionally utilizing Mo precipitation hardening, and (2) that, particularly in the development of ultra-high strength steels in which reliability is an especially great concern, it is difficult to adopt a composition design added with Ti because of concern regarding fatigue property degradation and other harmful effects of Ti addition.

This invention overcomes the difficulty of (1) by utilizing an allround combination of strengthening mechanisms wherein precipitation hardening by Mo and Ti is utilized on top of effective utilization of solid-solution hardening by C etc. and work-hardening by cold-working. It overcomes the difficulty of (2) by reducing N and strictly defining Ti content as 0.1–0.5 mass %. It was learned that an ultra-high strength on the order of 2200 $N/mm^2$ cannot be achieved at a Ti content of less than 0.1 mass % because the hardening effect of Ti cannot be fully utilized at this content level. On the other hand, when the Ti content exceeds 0.5 mass %, fatigue property decreases abruptly even if N is reduced as explained earlier. Ti content is therefore set at 0.1–0.5 mass % in this invention.

V (vanadium) forms carbides at high temperature. The precipitation hardening by these and the solid-solution hardening by V itself enhance steel strength. When V is contained at more that 0.5 mass %, however, the toughness of the steel is impaired. When V is added, therefore, its content must be made not more than 0.5 mass %.

Nb (niobium), like V, forms carbides at high temperature. The precipitation hardening by these and the solid-solution hardening by Nb itself enhance steel strength. When Nb is contained at more that 0.5 mass %, however, the toughness of the steel is impaired. When Nb is added, therefore, its content must be made not more than 0.5 mass %.

Mo-system precipitates are formed by aging in this invention. As the number of formation sites for these precipitates is increased by the Si addition, the size of the Mo-system precipitates is refined in proportion. To ensure sufficiently fine and uniform distribution of the Mo-system precipitates, it is necessary to control the total Si+Mo content to not less than 3.5 mass %. At this content, the Mo-system precipitates contribute markedly to strength enhancement.

In this invention, induced transformation of martensite by cold-working is positively utilized for enabling tensile strength of 2200 N/mm$^2$ or greater to be obtained with high reliability, and it is very advantageous to obtain a total martensite amount of 50–95 vol % prior to the aging step.

First, as a condition for this, most of the texture must consist of austenite phase following solution treatment. Through their research, the inventors learned that it is highly preferable for the texture following solution treatment to be either "austenite single phase" or "primarily of austenite phase and containing not more than 30 vol % of cooling-induced martensite phase."

Second, it is highly effective for the steel to have a chemical composition whereby working-induced martensite phase can be generated to obtain a total martensite amount of 50–95 vol % by cold-working at room temperature without need for extreme measures. In the case of cold rolling, for instance, it is preferable to be able to obtain the aforesaid amount of martensite at a moderate (easily implemented) rolling reduction ratio of, say, 20–60%, without conducting special strong working or temperature control. Sudden induction of martensite phase by only slight working at this time would make it impossible to obtain a sufficient degree of working (a sufficient degree of rolling reduction) and thus impossible to utilize the strength enhancing effect by work-hardening. Ultra-high strength would therefore not be achievable.

To satisfy these requirements, an alloy design that strictly defines the stability of the austenite phase against working is indispensable. In the present invention, the Md(N) value defined by the following equation (1) is adopted as an index of this stability:

$$Md(N)=580-520C-2Si-16Mn-16Cr-23Ni-300N-26Cu-10Mo \quad (1),$$

where C, Si, . . . , Mo represent C content, Si content, . . . , Mo content (each expressed in mass %).

In a steel whose Md(N) is less than 20, formation of sufficient martensite phase contributing to ultra-high strength cannot be realized because the austenite phase is stable against cold-working. In a steel whose Md(N) is greater than 140, the texture becomes almost totally martensite single phase at a relatively low cold rolling reduction ratio. This raises a concern regarding toughness degradation during cold rolling and also makes ultra-high strength difficult to achieve owing to insufficient cold-working. In this invention, therefore, the constituent element contents are controlled so that the value of Md(N) falls in the range of 20–140. The lower limit of the Md(N) value is preferably 60 and the upper limit thereof is preferably 135.

A steel of a chemical composition described in the foregoing is made, hot rolled, optionally cold rolled, and subjected to solution treatment to obtain a metallic texture consisting of metastable austenite single phase or consisting primarily of metastable austenite including some cooling-induced martensite phase. Owing to the aforesaid chemical composition control, the amount of cooling-induced martensite phase at this point is less than approximately 30 vol %.

In this invention, the solution-treated steel is cold-worked to introduce working strain. Most of the metastable austenite phase is transformed to martensite at this time. In order to obtain a tensile strength of not less than 2200 N/mm$^2$ after aging, it is very effective to make the amount of martensite in the steel at this stage not less than 50 vol % (preferably greater than 50 vol %). This enables the number of nucleus formation sites for precipitates that effectively contribute to hardening during aging to be increased to a sufficient level. For ensuring steel toughness, however, the texture should preferably not be 100% martensite. The preferable structure is a "multiphase texture" having total martensite amount of 50–95 vol % and a balance substantially of austenite phase. A steel whose Md(N) value has been adjusted to the aforesaid appropriate range can be imparted with such a multiphase texture relatively easily by controlling the cold-working ratio.

The cold-working is imparted by ordinary cold rolling. Depending on the purpose for which the steel is intended, however, the cold-rolled steel can be further subjected to some other type of cold-working such as spinning. Or it can be subjected to cold-working other than cold rolling from the start, i.e., from immediately after solution treatment. When wire or wire rod is to be produced, the steel is ordinarily subjected to wiredrawing. In all cases, in order to achieve an ultra-high strength steel of 2200 N/mm$^2$ class it is highly advantageous for the amount of martensite in the steel to be 50–95 vol % when ready for aging.

In the aging step, the cold-worked steel containing the large amount of martensite phase is heat-treated at a temperature in the range of 300–600° C. for a soaking period of 0.5–300 minutes. By setting the aging temperature at 300° C. or higher, precipitation hardening is thoroughly manifested and the desired ultra-high strength can be realized. Owing to the removal of excess working strain, moreover, good toughness is also obtained. When the heat treatment is carried out at a temperature higher than 600° C., however, the strain-induced martensite phase may experience recovery/recrystallization or may partially reverse-transform to austenite phase, thereby softening the steel. Adequate age-hardening cannot be expected at a soaking period of shorter than 0.5 minute. Prolonged heat treatment exceeding 300 minutes leads to softening caused by averaging and degradation of corrosion resistance owing to precipitation of carbide at the grain boundaries.

One characteristic of this invention is that it can be implemented using a soaking period for the aging step selected within a broad range of 0.5 minute to 300 minutes. This enables production of an ultra-high strength steel strip by continuously passing the cold-rolled strip through a heating furnace and also enables steel processed into desired components to be aged batchwise. At an operating site where batch processing is carried out, precise control of the soaking period to a short period such as several minutes is usually difficult. When batchwise aging is adopted, therefore, a soaking period of 10–300 minutes is preferably used.

By the aforesaid chemical composition control, solution treatment, cold-working and aging, there can be obtained a metallic texture characteristic of the invention steel, namely, a "texture exhibiting a cold worked multiphase texture composed of 50–95 vol % of martensite phase and the remainder substantially of austenite phase, and having $Fe_2Mo$, $Fe_3Mo$ and other Mo-system precipitates and $Ni_{16}Ti_6Si_7$, $Ni_3Ti$ and other Ti-system precipitates distributed in the martensite phase." This metastable austenitic stainless steel achieves a high strength on the order of 2200 $N/mm^2$.

WORKING EXAMPLES

Table 1 shows chemical composition values and Md(N) values of tested specimens. The chemical compositions designated T1–T8 in this table fall within the range specified by the present invention (Invention Steels) and those designated N1–N7 fall outside the invention range (Comparative Steels).

TABLE 1

| | (Mass %) | | | | | | | | | | | |
|---|---|---|---|---|---|---|---|---|---|---|---|---|
| No. | C | Si | Mn | Ni | Cr | Cu | Mo | N | Ti | Nb | V | Md (N) |
| T1 | 0.073 | 2.45 | 0.28 | 7.36 | 15.67 | 1.43 | 2.23 | 0.011 | 0.21 | 0.02 | 0.03 | 50 |
| T2 | 0.080 | 2.98 | 0.69 | 7.89 | 13.21 | 1.65 | 3.86 | 0.014 | 0.38 | 0.02 | 0.02 | 43 |
| T3 | 0.062 | 1.56 | 2.26 | 6.95 | 13.68 | 2.68 | 2.63 | 0.018 | 0.23 | 0.01 | 0.01 | 28 |
| T4 | 0.056 | 1.53 | 1.23 | 7.23 | 15.58 | 1.23 | 1.99 | 0.009 | 0.13 | 0.03 | 0.02 | 54 |
| T5 | 0.084 | 2.63 | 0.65 | 8.56 | 14.23 | 0.60 | 2.65 | 0.015 | 0.44 | 0.21 | 0.43 | 50 |
| T6 | 0.092 | 2.56 | 0.56 | 5.84 | 13.62 | 1.98 | 1.65 | 0.008 | 0.26 | 0.14 | 0.22 | 95 |
| T7 | 0.125 | 3.56 | 1.89 | 6.53 | 13.56 | 0.56 | 0.03 | 0.016 | 0.22 | 0.29 | 0.01 | 91 |
| T8 | 0.105 | 1.23 | 0.56 | 4.98 | 12.56 | 1.36 | 2.98 | 0.012 | 0.19 | 0.03 | 0.36 | 130 |
| N1 | 0.052 | 1.63 | 1.32 | 7.23 | 15.62 | 1.22 | 2.66 | 0.012 | 0.05 | 0.04 | 0.12 | 50 |
| N2 | 0.075 | 2.53 | 0.56 | 8.33 | 14.36 | 0.89 | 1.59 | 0.015 | 0.59 | 0.15 | 0.05 | 62 |
| N3 | 0.075 | 2.39 | 0.30 | 8.20 | 13.40 | 1.20 | 1.69 | 0.036 | 0.36 | 0.02 | 0.23 | 70 |
| N4 | 0.067 | 1.78 | 1.44 | 7.83 | 16.24 | 0.70 | 1.20 | 0.015 | 0.28 | 0.03 | 0.02 | 44 |
| N5 | 0.087 | 2.80 | 2.30 | 7.84 | 14.26 | 1.89 | 2.25 | 0.018 | 0.24 | 0.25 | 0.06 | 7 |
| N6 | 0.096 | 2.26 | 0.08 | 6.98 | 15.23 | 2.03 | 1.56 | 0.013 | 0.18 | 0.65 | 0.04 | 48 |
| N7 | 0.078 | 1.46 | 0.03 | 5.67 | 15.65 | 2.12 | 2.12 | 0.011 | 0.07 | 0.05 | 0.03 | 76 |

T1–T8: Invention Steels
N1–N7 Comparative Steels

All steels were made in a vacuum melting furnace, forged, hot rolled, interpass-annealed, cold rolled, subjected to solution treatment consisting of holding at 1050° C. for 1 minute and water cooling, and cold rolled at various reduction ratios to obtain cold-rolled sheets of 1.2–0.8-mm thickness. The cold-rolled sheets were aged at 525° C. for 60 minutes. Table 2 shows the cold-rolling reduction ratio of each specimen, the amount of martensite and tensile strength of the cold-rolled sheet, and the tensile strength and fatigue limit determined by a fatigue test of the aged sheet. The tensile test was conducted by the test method of JIS Z 2241 using the No. 13B test piece of JIS Z 2201. Fatigue was tested by a reversed bending fatigue test conducted at a frequency of 1800 rpm (min/max stress ratio R=−1) in conformity with JIS Z 2273. The surface maximum bending strain stress value at which breakage did not occur after $1\times10^7$ cycles was defined as the fatigue limit.

TABLE 2

| | Rolled steel | | | Aged steel (525° C. × 60 min) | |
|---|---|---|---|---|---|
| No. | Cold-rolling reduction ratio (%) | Martensite amount (Vol %) | Tensile strength ($N/mm^2$) | Tensile strength ($N/mm^2$) | Fatigue limit ($N/mm^2$) |
| T1 | 60 | 56 | 1709 | 2289 | 876 |
| T2 | 65 | 64 | 1723 | 2343 | 924 |
| T3 | 65 | 46 | 1650 | 2224 | 843 |
| T4 | 60 | 54 | 1679 | 2234 | 824 |
| T5 | 60 | 55 | 1703 | 2456 | 978 |

TABLE 2-continued

| | Rolled steel | | | Aged steel (525° C. × 60 min) | |
|---|---|---|---|---|---|
| No. | Cold-rolling reduction ratio (%) | Martensite amount (Vol %) | Tensile strength ($N/mm^2$) | Tensile strength ($N/mm^2$) | Fatigue limit ($N/mm^2$) |
| T6 | 50 | 75 | 1756 | 2267 | 850 |
| T7 | 55 | 88 | 1823 | 2423 | 1002 |
| T8 | 40 | 92 | 1843 | 2321 | 921 |
| N1 | 60 | 54 | 1621 | 2070 | 687 |
| N2 | 65 | 69 | 1756 | 2545 | 541 |

TABLE 2-continued

| | Rolled steel | | | Aged steel (525° C. × 60 min) | |
|---|---|---|---|---|---|
| No. | Cold-rolling reduction ratio (%) | Martensite amount (Vol %) | Tensile strength ($N/mm^2$) | Tensile strength ($N/mm^2$) | Fatigue limit ($N/mm^2$) |
| N3 | 60 | 72 | 1823 | 2352 | 519 |
| N4 | 60 | 51 | 1723 | 2134 | 698 |
| N5 | 70 | 52 | 1728 | 2023 | 654 |
| N6 | 60 | 54 | 1829 | 2432 | 620 |
| N7 | 60 | 62 | 1876 | 2188 | 680 |

T1–T8: Invention Steels
N1–N7: Comparative Steels

As can be seen from Table 2, steels N1 and N7, whose Ti content was less than 0.1 mass %, steel N4, whose Si+Mo content was less than 3.5 mass %, and steel N5, whose Md(N) value was less than 50, all failed to achieve a tensile strength of 2200 $N/mm^2$ or greater as aged steels. Steel N2, whose Ti content exceeded 0.5 mass %, and steel N3, whose N content exceeded 0.02 mass %, had inferior fatigue property. Steel N6, which had an excessive Nb content of greater than 0.5 mass %, experienced fatigue property degradation owing to excessive precipitation of Nb-system precipitates. In contrast, Invention Steels T1–T8 all achieved tensile strength of not less than 2200 $N/mm^2$ and were excellent in fatigue property as aged steels.

In FIG. 1, the tensile strengths of the steels T1, T2, T4, T5, N1 and N2 of Table 1 after 525° C.×60 min. aging are plotted against their Ti contents. It can be seen that ultra-high strength steels of a tensile strength of not less than 2200 $N/mm^2$ were obtained at Ti content of not less than 0.1 mass %.

Figure 2:
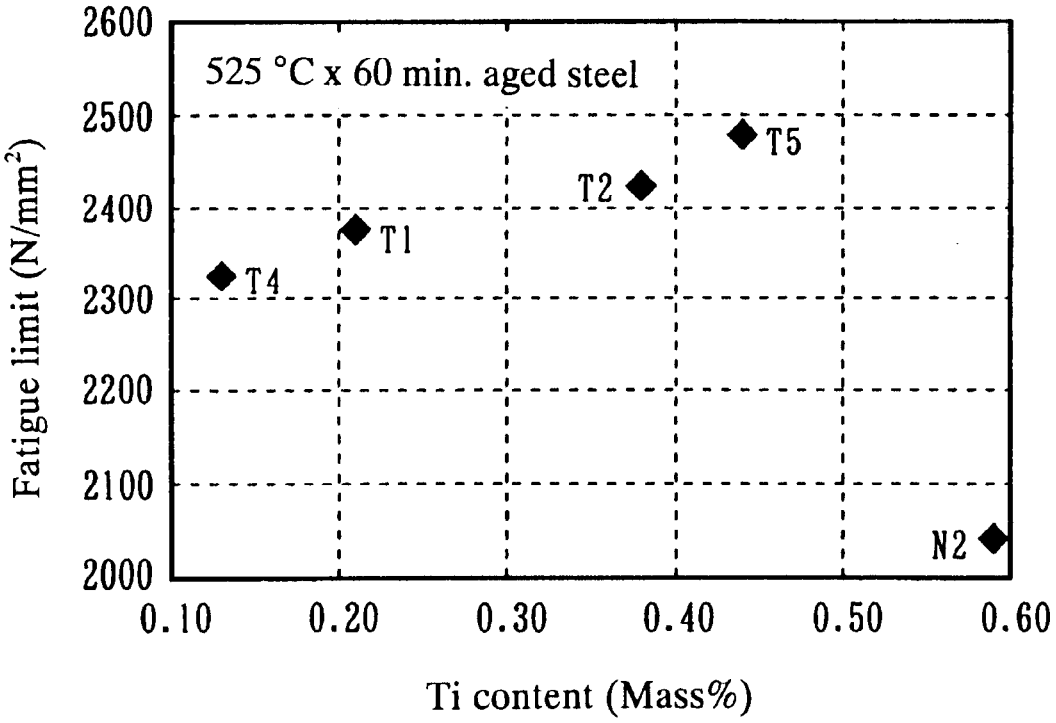
FIG. 2 is a graph showing the effect of Ti content on the fatigue limit of steels aged at 525° C. for 60 minutes.

In FIG. 2, the fatigue limits of the steels T1, T2, T4, T5 and N2 of Table 1 after 525° C.×60 min. aging are plotted against their Ti contents. It can be seen that the fatigue limit abruptly declined when the Ti content exceeded 0.5 mass %.

Figure 3:
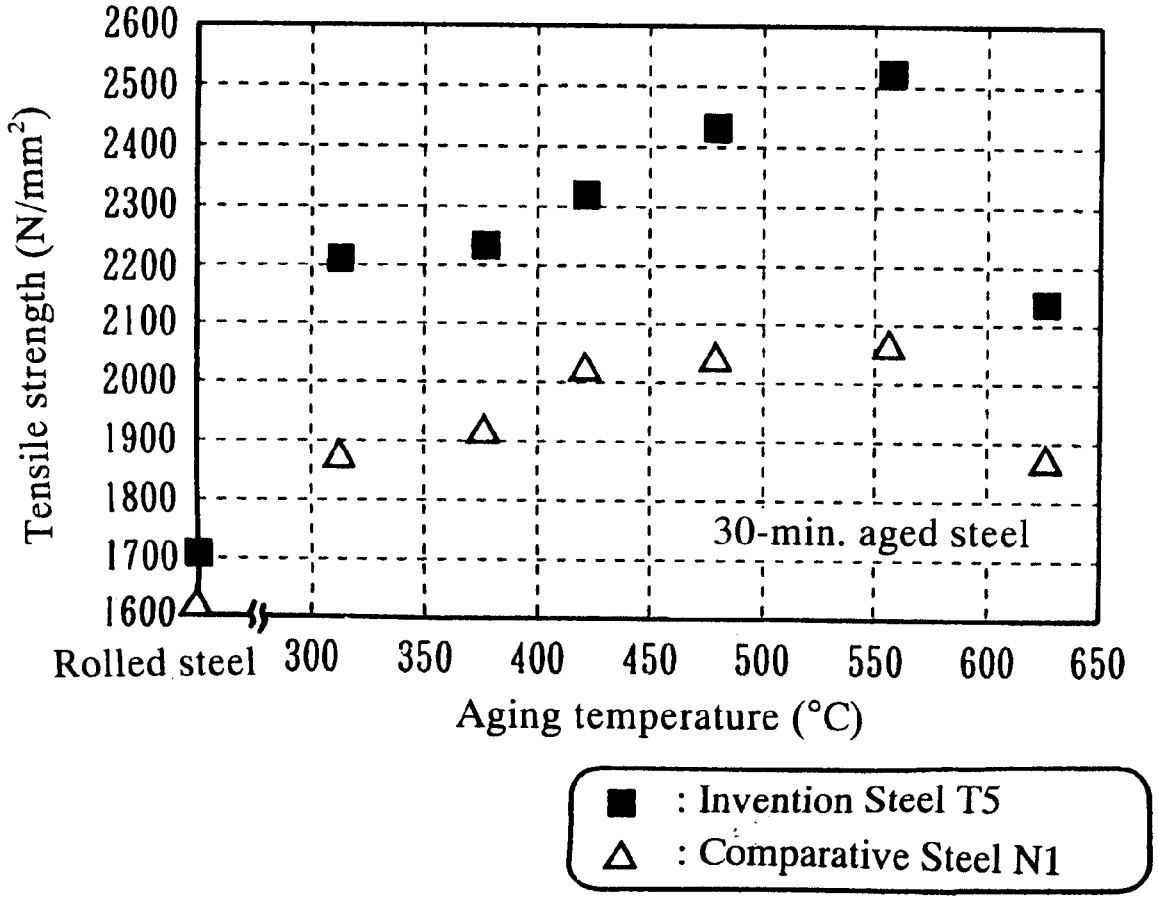
FIG. 3 is a graph showing the effect of aging temperature on the tensile strength of aged invention steels and comparative steels.

Steels T5 and N1 of Table 1 were aged at various temperatures for a soaking period 30 minutes and then tested for tensile strength. The results are shown in FIG. 3. In can be seen that Invention Steel T5 achieved tensile strength of not less than 2200 $N/mm^2$ in the range of 300–600° C.

The present invention enables ultra-high strength of not less than 2200 $N/mm^2$, comparable to the tensile strength of 18Ni maraging steel, to be realized in a metastable austenitic stainless steel. The present invention thus has major technological significance in the point of achieving of an improvement in strength of 10% or more over conventional high-strength stainless steels.

What is claimed is:

1. An ultra-high strength metastable austenitic stainless steel:

having a chemical composition that comprises, in mass %,
- not more than 0.15% of C,
- more than 1.0 to 6.0% of Si,
- not more than 5.0% of Mn,
- 4.0–10.0% of Ni,
- 12.0–18.0% of Cr,
- not more than 3.5% of Cu,
- not more than 5.0% of Mo,
- not more than 0.02% of N,
- 0.1–0.5% of Ti, and
- the balance of Fe and unavoidable impurities, satisfies Si+Mo≧3.5%, and has a value of Md(N) defined by equation (1) below of 20–140;

exhibiting a cold worked multiphase texture composed of 50–95 vol % of martensite phase and the remainder substantially of austenite phase;

having a tensile strength of not less than 2200 $N/mm^2$; and having Mo-system precipitates and Ti-system precipitates distributed in the martensite phase;

wherein, $$Md(N)=580-520C-2Si-16Mn-16Cr-23Ni-300N-26Cu-10Mo.$$

2. A steel according to claim 1, wherein the steel further comprises at least one of hot more than 0.5 mass % of V and not more than 0.5 mass % of Nb.

3. An ultra-high strength metastable austenitic stainless steel according to claim 1, wherein Cu content is 1.0–3.0 mass % and Mo content is 1.0–4.5 mass %.

4. An ultra-high strength metastable austenitic stainless steel according to claim 1, where the steel is sheet steel or wire steel.

5. A method of producing an ultra-high strength metastable austenitic stainless steel having a tensile strength of not less than 2200 $N/mm^2$, said method comprising:

solution-treating a steel having a chemical composition that comprises, in mass %,
- not more than 0.15% of C,
- more than 1.0 to 6.0% of Si,
- not more than 5.0% of Mn,
- 4.0–10% of Ni,
- 12.0–18.0% of Cr,
- not more than 3.5% of Cu,
- not more than 5.0% of Mo,
- not more than 0.02% of N,
- 0.1–0.5% of Ti, and
- the balance of Fe and unavoidable impurities; satisfies Si+Mo≧3.5%; and has a value of Md(N) defined by equation (1) below of 20–140;

wherein, $$Md(N)=580-520C-2Si-16Mn-16Cr-23Ni-300N-26Cu-10Mo \quad (1);$$

cold-working the solution-treated steel to obtain a steel having a metallic texture composed of 50–95 vol % of martensite phase, and aging the cold-worked steel in a temperature range of 300–600° C. for 0.5–300 minutes.

6. A method according to claim 5, wherein the steel further comprising at least one of not more than 0.5 mass % of V and not more than 0.5 mass % of Nb.

7. A method according to claim 5, wherein the steel has a Cu content of 1.0–3.0 mass % and a Mo content of 1.0–4.5 mass %.

8. A method according to claim 5, wherein the steel subjected to aging is a steel having a metallic texture composed of 50–95 vol % of martensite phase obtained by conducting the solution-treating step to attain a texture consisting of austenite single phase or a texture consisting primarily of austenite phase and containing not more than 30 vol % of cooling-induced martensite phase and thereafter cold-working the steel to generate strain-induced martensite phase.

9. A method according to claim 5, wherein the aging step is conducted batchwise for 10–300 minutes.

* * * * *